United States Patent [19]

Bolduc et al.

[11] 4,029,230

[45] June 14, 1977

[54] DRUM HANDLING ATTACHMENT

[75] Inventors: Wayne J. Bolduc, Claymont; Vernon E. Cave, Newark, both of Del.; Edward J. Chase, San Pedro, Calif.

[73] Assignee: Container Corporation of America, Chicago, Ill.

[22] Filed: May 21, 1976

[21] Appl. No.: 688,754

[52] U.S. Cl. ..... 214/654; 214/620; 214/653

[51] Int. Cl.² ..... B66F 9/18

[58] Field of Search ..... 214/650 R, 651, 652, 214/653, 654, 655, 620, 147 R, DIG. 4

[56] References Cited

UNITED STATES PATENTS

| | | | |
|---|---|---|---|
| 2,905,347 | 9/1959 | Hopfeld | 214/654 |
| 2,987,204 | 6/1961 | Wallace | 214/653 |

FOREIGN PATENTS OR APPLICATIONS

| | | | |
|---|---|---|---|
| 816,222 | 10/1951 | Germany | 214/653 |
| 825,492 | 12/1959 | United Kingdom | 214/653 |

*Primary Examiner*—Frank E. Werner
*Attorney, Agent, or Firm*—Carpenter & Ostis

[57] ABSTRACT

The attachment is mounted on a lift portion of a lift truck, or the like. A frame member is operatively connected to upper and lower article engaging elements which engage a top and a side of an article, such as a drum, for movement and handling of same.

7 Claims, 2 Drawing Figures

DRUM HANDLING ATTACHMENT

BACKGROUND OF THE INVENTION

1. Field of the Invention:

This invention relates to article handling devices and, more particularly, to an attachment operatively mounted on a lift truck, or the like, for engaging and moving articles such as drums, or the like.

2. The prior art:

Heretofore, there has been an absence of an adequate device for engaging and moving fairly large plastic or paper drums without damaging the same. The devices used heretofore were not reliable from the article-safety point of view since they tended to puncture or otherwise damage the drums. The present invention overcomes the disadvantages of the prior art and provides a safe and efficient handling and lifting device.

SUMMARY OF THE INVENTION

Generally, the device of the present invention is movably mounted on a lift truck, or the like, and has structure operatively joined to article engaging elements. The article, such as a drum, is engaged by two article engaging elements. Usually, one element engages the drum at its top while the other one engages a side of the drum. The article is thusly lifted, transported and handled as required.

DRAWINGS

Figure 1:
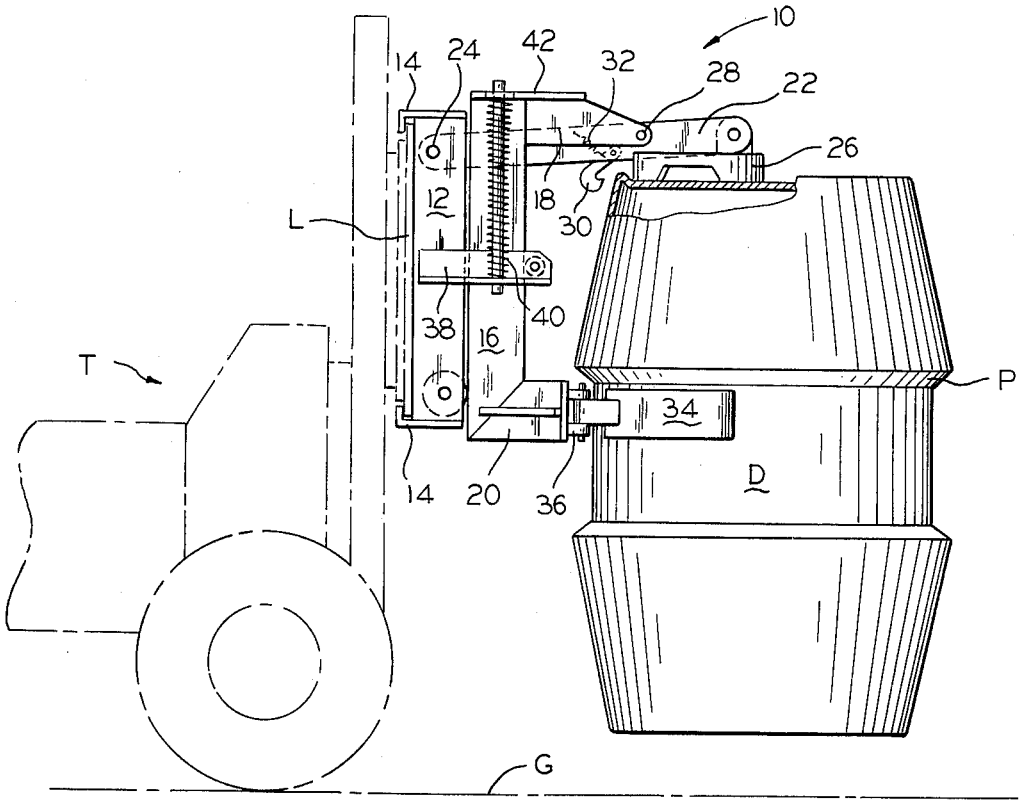
FIG. 1 is a side elevational view of the attachment of the present invention mounted on a lift truck (shown in phantom) and engaging a drum.
Figure 2:
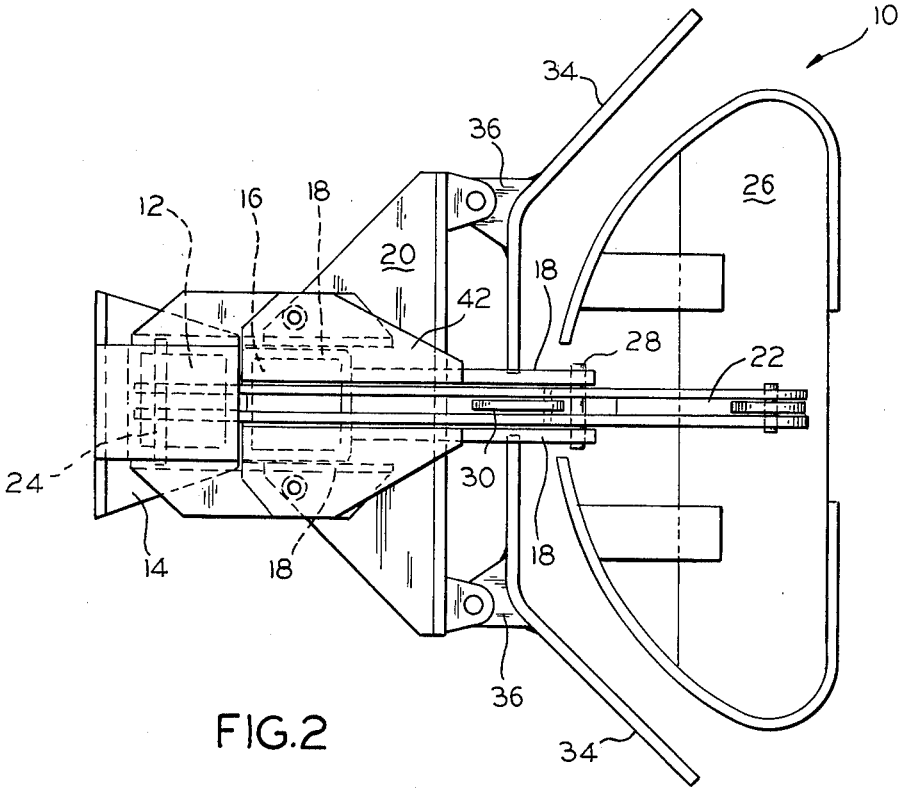
FIG. 2 is a top plan view of the attachment of the present invention.

Referring now to the drawings, more specifically to FIG. 1 there is shown a device of the present invention comprising a drum handling attachment, generally designated 10, mounted on a lift portion L of a lift truck T and holding a drum D in an elevated position above a ground G.

The device illustrated in the exemplary embodiment is designed for attachment to a lift truck. Attachment of the device to other objects could be accomplished by means known in the art.

Figure 3:
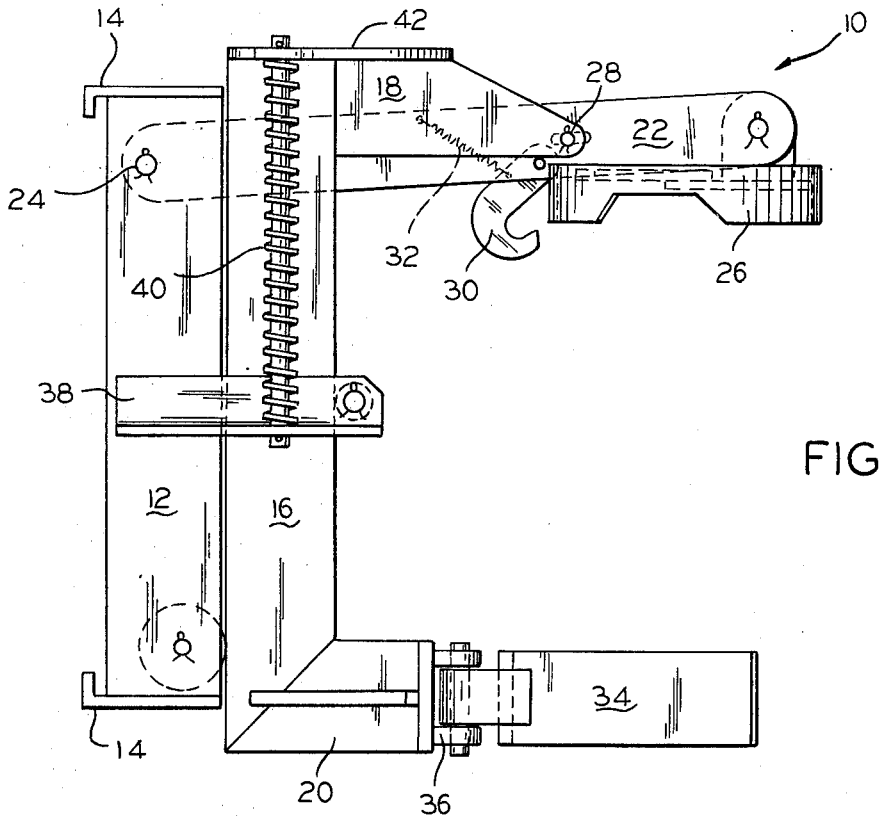
FIG. 3 is a side elevational view of the attachment, similar to FIG. 1 but with the truck and the drum deleted.

As best seen in FIG. 1 and 3, the drum handling attachment 10 has a mounting bracket 12 with upper and lower angle brackets 14 for engaging the lift portion L of the truck T for vertical movement with said lift portion. A frame member 16 is operatively connected to the mounting bracket 12. The member 16 has a pair of upper horizontal extension 18 and a lower horizontal extension 20.

An arm 22 has one of its ends pivotally mounted, by pin 24, or the like, on the mounting bracket 12 while its other end is operatively attached to a movable article engaging element 26. The arm 22 is pivotally attached between the pair of upper horizontal extensions 18 by a pin member 28.

A hook 30 biased by a spring 32 is movable secured to the arm 22 for engagement with the upper chime of certain drums (such as steel and combination) when such chimed drums are being handled by the device 10.

The lower horizontal extension 20 is operatively connected to a second article engaging element 34 which, in the embodiment illustrated, is in a form of a clamp pivotally attached to the extension 20 by brackets 36, or the like.

Figure 4:
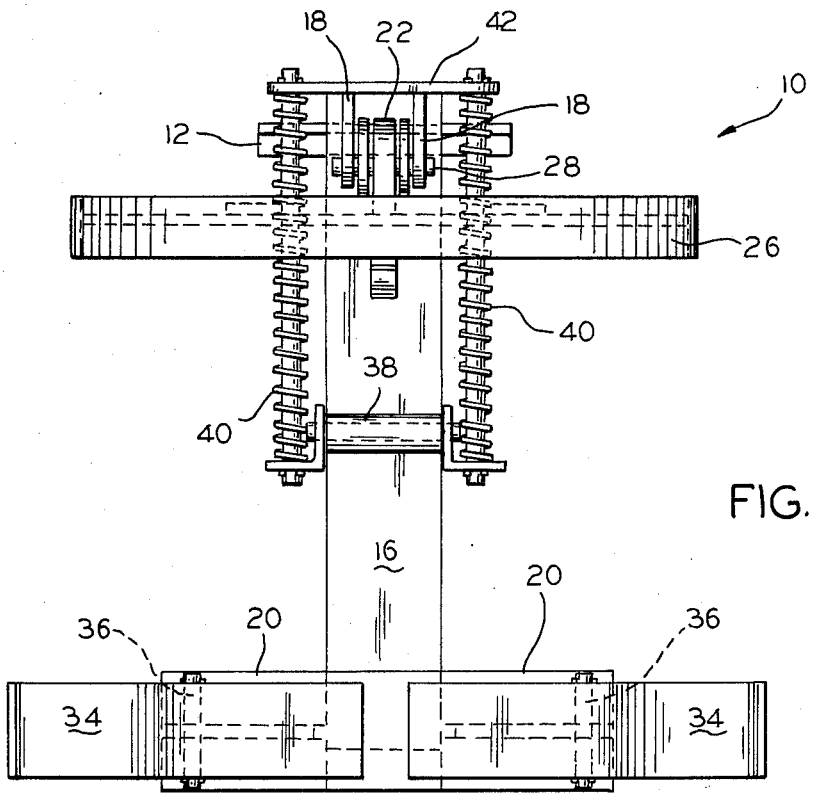
FIG. 4 is a front elevational view of the attachment of FIG. 3.

A spring retaining bar 38 is mounted centrally on said frame member to hold one end of a spring 40. As best seen in FIG. 4, the drum handling attachment of the present invention employs two identical springs 40, each located on one side of the frame member 16. The other end of the spring 40 is securely held by bracket 42 located on the top of the member 16.

In operation of the device, the structure is attached to the lift portion of a lift truck. The arm 22 is placed over a top of an article, such as a drum, so that the article engaging element 26 attached to the arm 22 contacts the top of the drum. The lower article engaging element 34 is positioned in contacting engagement with the central portion of the drum immediately below a projection P as shown in FIG. 1. The lift truck operator raises the lift L of the truck T thus moving the mounting bracket 12 of the attachment 10. A pinching action takes place between the arm 22 and the lower, clamp-like, article engaging element 34 when the mounting bracket 12 is raised by movement of the lift L. The frame member 16 and the element 34 do not move until they support the weight of the article, a drum in this case.

When the element 34 engages the sdie of the drum, as described above, a cantilever action is produced on the arm 22 so that the article engaging element 26 grasps the top of the drum and thus a pinching action is attained on the drum by and between the engaging elements 26 and 34. A holding action produced by the weight of the article D and the pivoting arm 22 squeezes the article between the elements 26 and 34.

When the article D is to be deposited, it is lowered to the ground level so that the weight of the article is removed from the lower engaging element 34, the truck T is backed away a slight distance, and the lift L is raised slightly thereby moving the upper article engaging element 26 away from the top of the article.

To enable the drum handling attachment to pick up, transfer and deposit either steel or steel-fiber composition drums having chimes, the hook 30 biased by the spring 32 is used. When the hook engages the chime of the article, the weight of the article pulls the hook forward toward the upper article engaging element 26 producing a pinching action between the hook and the element thus holding and supporting the article. Lowering of the lift L and placement of the article on the ground will cause the hook 30 to disengage from the chime so that the attachment 10 can be moved away from the article.

We claim:

1. In an attachment mounted for movement on a lift of a lift truck, or the like, said attachment comprising:

a. a mounting bracket secured to said lift and movable therewith;

b. a frame member operatively connected to said mounting bracket and having upper and lower horizontal extensions;

c. an arm having one of its ends pivotally mounted on said mounting bracket and having:

i. a first article engaging element movably secured to the opposite end of said arm;

ii. a pin member pivotally connecting said arm to said frame member at said upper horizontal extension;

d. a second article engaging element secured to said lower horizontal extension.

2. The attachment as defined in claim 1, wherein said frame member is provided with a spring retaining bar.

3. The attachment as defined in claim 2, wherein spring means extends between said retaining bar and said upper horizontal extension.

4. The attachment as defined in claim 1, wherein said arm carries a spring biased hook.

5. The attachment as defined in claim 1, wherein said first article engaging element has an engaging surface the configuration of which is adapted to mate with configuration of the top of said article.

6. The attachment as defined in claim 1 wherein said second article engaging element has a clamp-like configuration.

7. In an attachment mounted for movement on a lift of a lift truck, or the like, said attachment comprising:

a. a mounting bracket engaging said lift and being movable therewith;

b. a movable frame member having upper and lower horizontal extensions and being operatively connected to said mounting bracket;

c. an arm having one of its ends pivotally mounted on said mounting bracket and having:

i. a first article engaging element movably secured to the opposite end of said arm;

ii. a pin member pivotally connecting said arm to said frame member at said upper horizontal extension;

d. a second article engaging element secured to said lower horizontal extension;

e. a central stationary spring retaining bar located centrally of said frame member;

f. spring means extending between said bar and said upper horizontal extension.

* * * * *